US009706885B1

(12) United States Patent
Alhuraibi

(10) Patent No.: US 9,706,885 B1
(45) Date of Patent: Jul. 18, 2017

(54) WATER DISPENSER FOR PERSONAL HYGIENE

(71) Applicant: Shayma S. J. M. Alhuraibi, Safat (KW)

(72) Inventor: Shayma S. J. M. Alhuraibi, Safat (KW)

( * ) Notice: Subject to any disclaimer, the term of this patent is extended or adjusted under 35 U.S.C. 154(b) by 0 days.

(21) Appl. No.: 15/377,984

(22) Filed: Dec. 13, 2016

(51) Int. Cl.
*A47K 3/022* (2006.01)
*A47K 3/26* (2006.01)
*A61H 35/00* (2006.01)
*A47K 7/08* (2006.01)

(52) U.S. Cl.
CPC . *A47K 7/08* (2013.01); *A47K 3/26* (2013.01)

(58) Field of Classification Search
CPC .. A47K 7/08; A47K 3/26; B01L 3/505; B65D 1/0292; B65D 11/18
USPC ..... 4/443, 615, 602, 603, 616; 222/92, 106, 222/206, 633, 209, 211, 522, 523, 527, 222/529; 220/9.1, 9.2, 9.4, 666
See application file for complete search history.

(56) References Cited

U.S. PATENT DOCUMENTS 542,688 A * 7/1895 Shackleford ..... A47K 3/286 4/616
1,493,592 A 5/1924 Beck
2,432,025 A * 12/1947 Lorenz ..... B64D 37/06 137/590
2,613,169 A * 10/1952 Cunningham ..... B29D 22/003 156/165
3,016,938 A * 1/1962 Akrep ..... B65D 37/00 220/666
3,618,846 A * 11/1971 Poli ..... B23K 1/018 222/206
3,925,830 A * 12/1975 Delaney ..... A61H 35/006 4/615
3,973,286 A * 8/1976 Logan ..... A47K 3/022 15/104.92
4,413,757 A * 11/1983 Adler ..... F41H 9/10 222/105
4,592,492 A * 6/1986 Tidmore ..... B65D 1/323 222/209
4,622,704 A 11/1986 Chung
4,921,147 A * 5/1990 Poirier ..... B65D 25/44 138/121
D355,256 S 2/1995 Weir
5,447,110 A * 9/1995 Brown ..... B65D 1/0292 141/114

(Continued)

FOREIGN PATENT DOCUMENTS

KR 10-2012-0038122 4/2012

*Primary Examiner* — J. Casimer Jacyna
*Assistant Examiner* — Benjamin R Shaw
(74) *Attorney, Agent, or Firm* — Richard C. Litman

(57) ABSTRACT

A water dispenser for personal hygiene includes an upper cover member, a lower cover member, and a compressible member disposed between the upper cover member and the lower cover member. The upper cover member has a first opening for receiving water and a second opening for discharging water. The water dispenser also includes a telescoping tower disposed within the compressible member between the upper cover member and the lower cover member. The telescoping tower includes a plurality of tiers, with each of the plurality of tiers having a plurality of openings. A hose is releasably coupled to the water dispenser.

16 Claims, 12 Drawing Sheets

(56) References Cited

U.S. PATENT DOCUMENTS

| | | | | | |
|---|---|---|---|---|---|
| 5,862,940 | A * | 1/1999 | Chism | B65D 37/00 | 220/666 |
| 5,864,895 | A | 2/1999 | Ota et al. | | |
| 5,897,012 | A * | 4/1999 | Sortwell | B65D 19/12 | 206/600 |
| 5,911,520 | A * | 6/1999 | Kenney | A47K 3/288 | 4/603 |
| 5,979,326 | A * | 11/1999 | Ohinata | B41J 2/1752 | 101/494 |
| 6,047,848 | A * | 4/2000 | Davis | B65D 1/0292 | 215/382 |
| 6,220,474 | B1 * | 4/2001 | Bedon | B65D 83/0061 | 220/666 |
| 6,568,610 | B1 * | 5/2003 | Ericksen | A01G 25/14 | 138/DIG. 8 |
| 6,763,973 | B1 * | 7/2004 | Hudkins | B65D 21/023 | 222/1 |
| 6,866,039 | B1 * | 3/2005 | Wright | A61M 15/0041 | 128/203.15 |
| 6,945,438 | B1 * | 9/2005 | Shih | A01M 7/0035 | 222/186 |
| 6,955,662 | B2 | 10/2005 | Moser et al. | | |
| 7,155,754 | B2 | 1/2007 | Chung | | |
| 7,814,586 | B1 * | 10/2010 | Samuels | A47K 3/288 | 4/612 |
| 7,971,803 | B1 * | 7/2011 | Barlowe | B05B 9/007 | 222/333 |
| 9,179,806 | B2 * | 11/2015 | Allos | B05B 1/24 | |

* cited by examiner

WATER DISPENSER FOR PERSONAL HYGIENE

BACKGROUND OF THE INVENTION

1. Field of the Invention

The present invention relates to a device for maintaining personal hygiene, and particularly to a water dispenser for personal hygienic use.

2. Description of the Related Art

Generally, bidets and similar washing devices are fixed to the seat of the toilet or fixed to the floor next to the toilet. Such devices are directly and permanently connected to a water source in a building. As such, these devices cannot easily be transported outside of the building to use, for example, while camping or traveling. Thus, there is an increasing demand for portable body washers and/or bidets.

Thus, a water dispenser for personal hygiene solving the aforementioned problems is desired.

SUMMARY OF THE INVENTION

A water dispenser for personal hygiene includes an upper cover member, a lower cover member, and a compressible member disposed between the upper cover member and the lower cover member. The upper cover member has a first opening for receiving water and a second opening for discharging water. The water dispenser also includes a telescoping tower disposed within the compressible member between the upper cover member and the lower cover member. The telescoping tower includes a plurality of tiers, with each of the plurality of tiers having a plurality of openings. A hose is releasably coupled to the water dispenser at one end and to a water sprayer or an extension member at another end. The water dispenser can also include an elongated push member.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
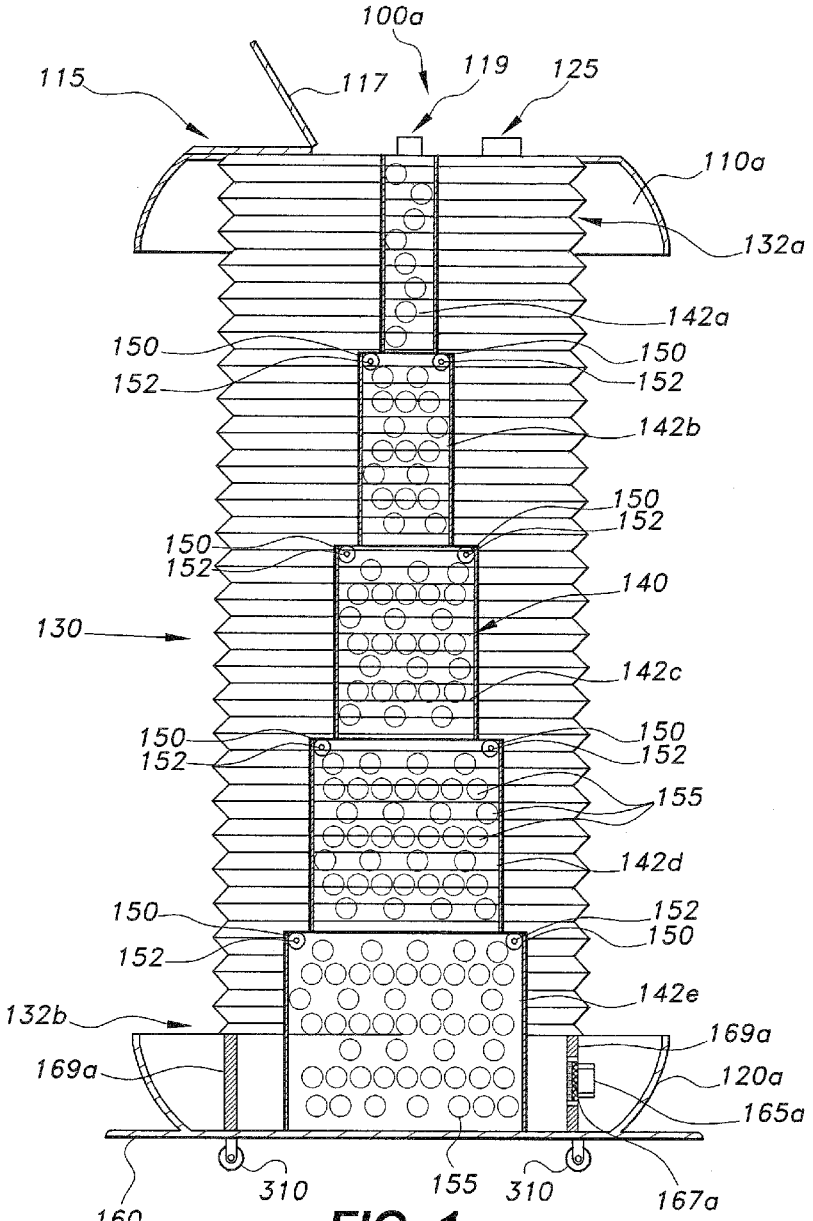
FIG. 1: is a cross sectional view of a water dispenser for personal hygiene, according to the present invention.

FIGS. 1 through 11 depict various embodiments of a water dispenser for personal hygiene. A first embodiment of the water dispenser for personal hygiene, generally designated as 100*a*, is shown. The water dispenser 100*a* includes an upper cover member 110*a*, a lower cover member 120*a*, and a cylindrical, accordion-like compressible member 130 positioned between the upper cover member 110*a* and the lower cover member 120*a*, the cylindrical, accordion-like compressible member 130 having an upper portion 132*a* and a lower portion 132*b*. The compressible member 130 is adapted for holding a fluid, such as water, therein. A telescoping tower 140 is positioned within the cylindrical, accordion-like compressible member, and a hose 200 (FIGS. 2A and 2B) may be detachably connected to either the upper cover member 110*a* or the lower cover member 120*a*. Further, the water dispenser 100*a* includes a step-on member 160, such as a rubber step-on member 160, positioned beneath the lower cover member 120*a*. The step-on member 160 can be secured onto the lower cover member 120*a* by any type of suitable fasteners 800, such as screws, or via plastic welding.

The upper cover member 110*a* and the lower cover member 120*a* can be formed from any suitable material, such as plastic, and can have any suitable shape, such as a circular shape, such as a generally circular shape, so as to attach, such as by plastic welding, onto the upper portion 132*a* and the lower portion 132*b*, respectively, of the cylindrical, accordion-like compressible member 130. A person can grip the sides of the upper member 110*a* when pulling the upper cover member 110*a* in a direction, such as an upward direction, while standing on the step-on member 160 positioned beneath the lower cover member 120*a* to stabilize the water dispenser 100*a* when separating the upper member 110*a* from the lower member 120*a* to expand the cylindrical, accordion-like compressible member 130 and, in turn, fill the cylindrical, accordion-like compressible member 130 and telescoping member 140 with fluid, such as water.

Figure 3:
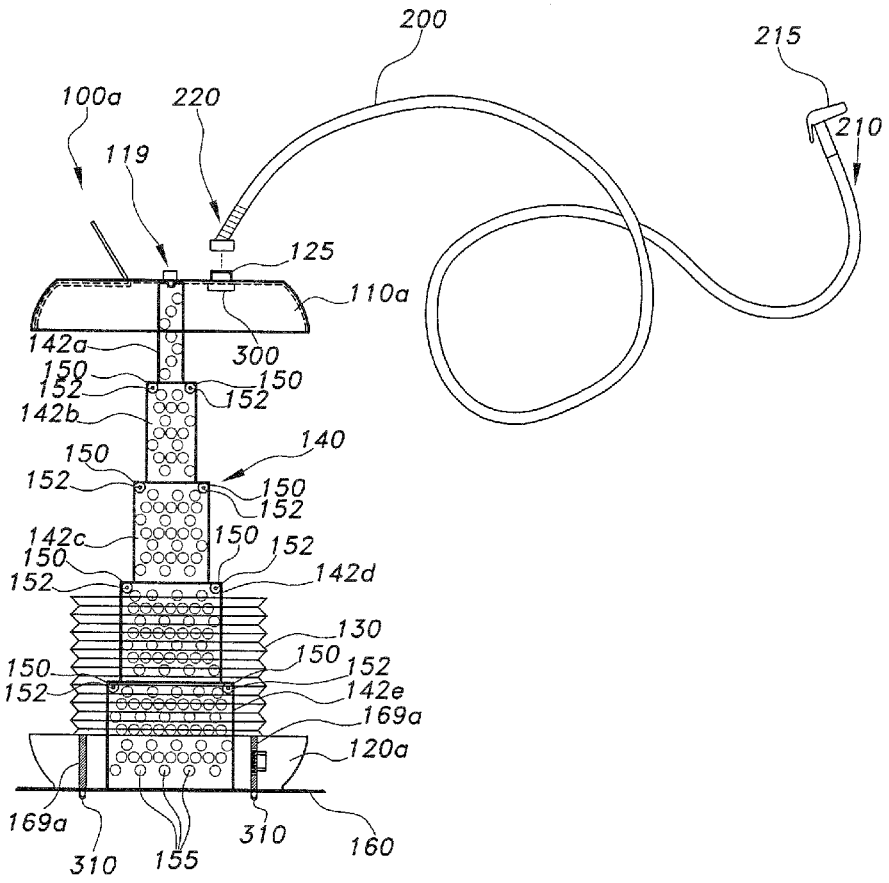
FIG. 3 illustrates the proximal end of the hose being attached to the upper cover member of the water dispenser for personal hygiene, according to the present invention.
Figure 4:
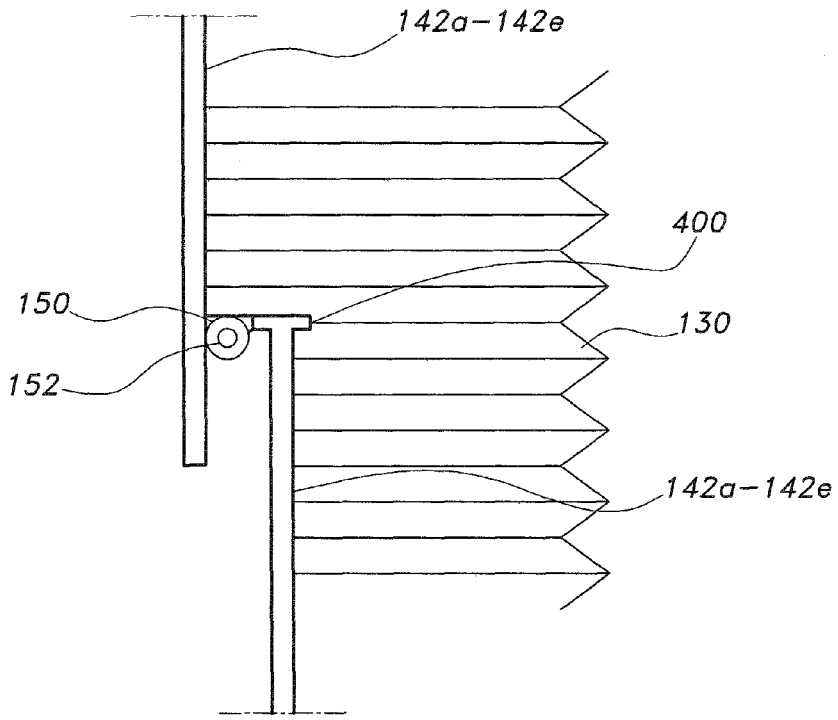
FIG. 4 is an exploded view of an interior portion of the compressible member of the water dispenser for personal hygiene, according to the present invention.
Figure 5:
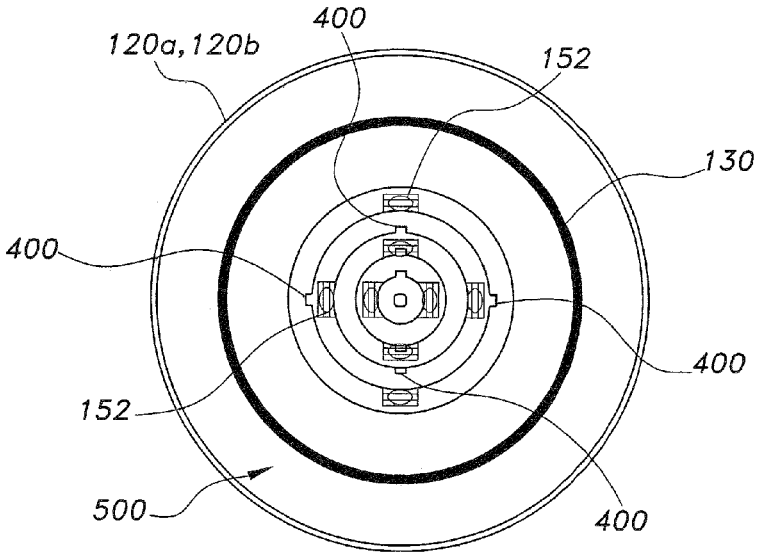
FIG. 5 is a top view of the water dispenser for personal hygiene without an upper cover member, according to the present invention.

The upper cover member 110*a* includes a first opening 115 and a corresponding cover member 117 configured for selectively covering the first opening 115. The upper cover member 110*a* further includes a second opening 125 and an attachment member 119. The first opening 115 of the upper cover member 110*a* can be used as an opening through which fluid, such as water, can be poured into the compressible member 130. The second opening 125 of the upper cover member 110*a*, on the other hand, is configured for receiving the hose 200 for dispensing water out of the water dispenser 100*a*. A wire mesh 300, as illustrated in FIG. 3, and optionally, a thin fabric (not shown), can extend across the second opening 125 for filtering and softening the water flow before the water is discharged through the hose 200.

The lower cover member 120*a* can include an opening 165*a* configured for receiving hose 200 for dispensing water out of the water dispenser 100*a*. When the water is being dispensed out of the opening 165*a* on the lower cover member 120*a*, the openings 115, 125 on the upper cover member 110*a* will typically be covered so as to prevent, such as substantially prevent, water from escaping therethrough. Furthermore, similar to the second opening 125 of the upper cover member 110*a*, a wire mesh 167*a*, as illustrated in FIG. 1, and optionally, a thin fabric (not shown) can extend across the opening 165*a* of the lower cover member 120*a* for filtering and softening the water flow before the water is discharged through the hose 200. The lower cover member 120*a* can include a supporting ring 169*a*.

The upper cover member 110*a* can also include at least one elastic band 610, e.g., a rubber band, which can be extended to the lower cover member 120*a* and secured thereon for keeping the water dispenser 100*a* in a closed position, e.g., when the cylindrical, accordion-like compressible member 130 is empty and in a collapsed or compressed state. For example, once air and water have been removed from the water dispenser 100*a*, the upper cover member 110*a* and the lower cover member 120*a* can be pressed together and the at least one band 610 can be used to maintain the upper cover member 110*a* and the lower cover member 120*a* together, such as for storage and/or transport.

The water dispenser 100*a* can include a plurality of wheels 310, such as retractable wheels, to facilitate moving the water dispenser 100*a* from one place to another. The lower cover member 120*a* can include a storage compartment 500 for the hose 200. After use, the hose 200 can be wrapped around the compressible member 130 and stored in the storage compartment 500 of the lower cover member 120*a*.

The compressible member 130 can be formed from plastic, or any suitable, flexible material. The telescoping tower 140 positioned within the compressible member 130, as illustrated in FIGS. 1, 3, 4, 6, 9, and 10, includes a plurality of tiers, such as a first tier 142*a*, a second tier 142*b*, a third tier 142*c*, a fourth tier 142*d*, and a fifth tier 142*e*. Each of the plurality of tiers 142*a*-142*e* are configured for collapsing into a lower, adjacent tier when the upper cover member 110*a* is pressed downward toward the lower cover member 120*a*, e.g., to discharge the water contained in the compressible member 130. The tops of the second tier 142*b*, third tier 142*c*, fourth tier 142*d*, and fifth tier 142*e* each include a plurality of wheels 150, such as rubber wheels, to allow each tier to easily slide into or out of a lower, adjacent tier when discharging water from the cylindrical, accordion-like compressible member 130.

Each of the wheels 150 can be attached to the corresponding tier 142*a*-142*e* by any suitable means, such as with a rod 152, similar to a tire rod for tires, so that each of the wheels 150 can rotate about the rod 152 to allow each of the tiers to expand or collapse into the subsequent tier. Each tier 142*a*-142*e* can have a flange 400 configured for preventing the plurality of tiers 142*a*-142*e* from collapsing unintentionally and for preventing the disassembly of the arrangement of each of the plurality of tiers 142*a*-142*e* when the telescoping tower 140 is in a raised position.

Each of the plurality of tiers 142*a*-142*e* includes a plurality of openings 155. When the plurality of tiers 142*a*-142*e* of the telescoping tower 140 are expanded, water enters into the telescoping tower 140 through each of the plurality of openings 155. Water leaves the telescoping tower 140 through each of the plurality of openings 155 when the telescoping tower 140 is compressed.

When the telescoping tower 140 is compressed, each of the plurality of openings 155 on each of the plurality of tiers 142*a*-142*e* can allow the telescoping tower 140, in combination with the compressible member 130, to control the pressure of the flow of water through the hose 200.

The hose 200 includes a proximal end 220 adapted for attaching to either the second opening 125 of the upper cover member 110*a* or the opening 165*a* of the lower cover member of the water dispenser 100*a*, and a distal end 210 for discharging water. The distal end 210 of the hose 200 can be attached to a water sprayer 215 (FIG. 2A) configured for discharging the water from the water dispenser 100*a* to a desired location. The distal end 210 of the hose 200 can also be attached to a bendable extension member 225 that can be configured for discharging the water from the water dispenser 100*a* into hard to reach places.

Figure 2A:
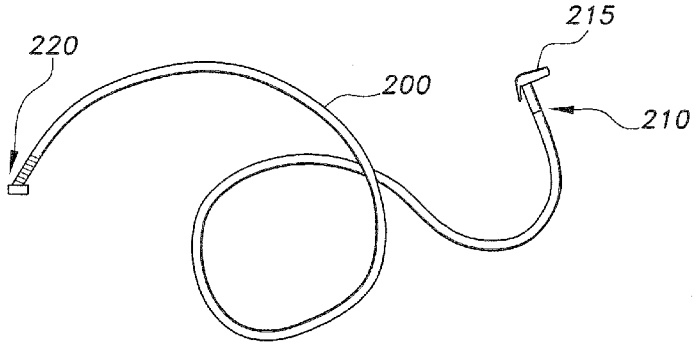
FIG. 2A: illustrates a water sprayer connected to the hose, according to the present invention.
Figure 2B:
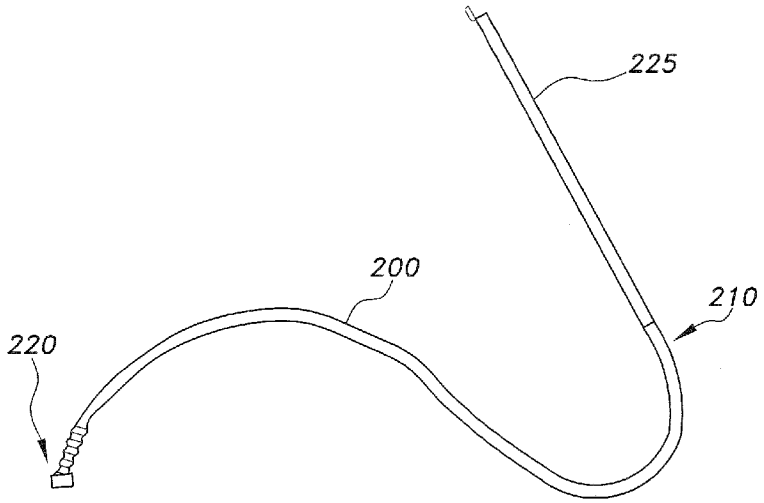
FIG. 2B illustrates an extension member connected to the hose, according to the present invention.
Figure 2C:
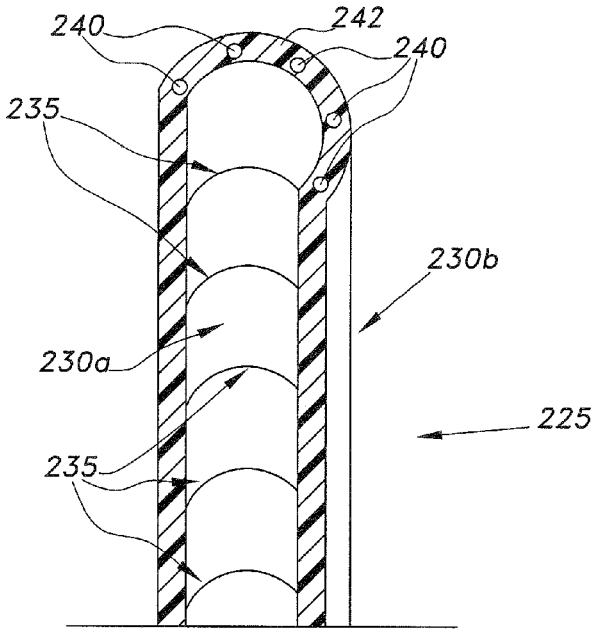
FIG. 2C illustrates a cross section of the extension member, according to the present invention.
Figure 2D:
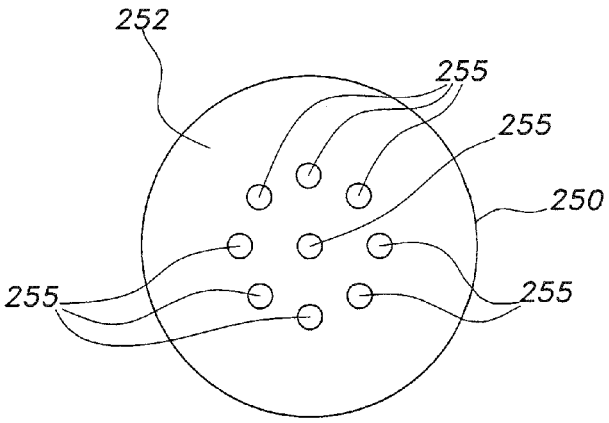
FIG. 2D illustrates the tip of the extension member, according to the present invention.

As shown in FIG. 2*c*, the bendable extension member 225 includes an inner layer 230*a* and an outer layer 230*b*. Both the inner layer 230*a* and the outer layer 230*b* can be formed from any suitable type of material, such as rubber or plastic. A plurality of metal support rings 235 are positioned along the inner layer 230*a* of the bendable extension member 225. A plurality of bendable metal rods 240 are inserted in between the inner layer 230*a* and outer layer 230*b*. The bendable extension member 225 can have a foam filling 242 between the inner layer 230*a* and the outer layer 230*b*. As shown in FIG. 2D, the bendable extension member 225 can also include a tip 250, such as a plastic tip, having a barrier 252 extending thereacross with a plurality of openings 255 configured for controlling the flow of water coming through the bendable extension member 225 and onto the affected area(s) of the user's body.

Figure 6:
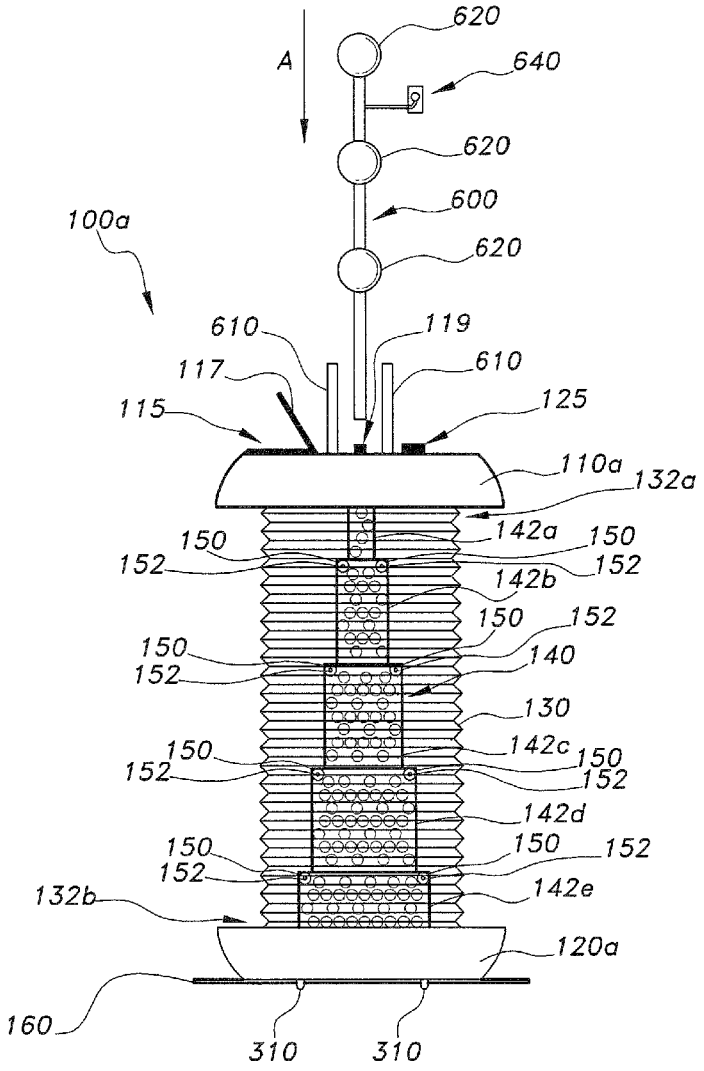
FIG. 6 illustrates an elongated push member separated from the upper cover member of the water dispenser for personal hygiene, according to the present invention.
Figure 7:
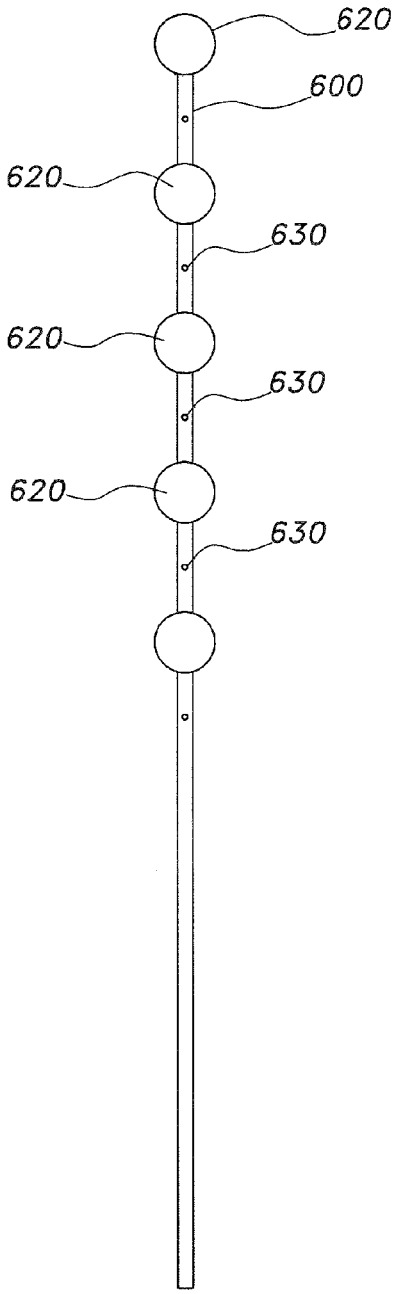
FIG. 7 is a side view of the elongated push member, according to the present invention.
Figure 8:
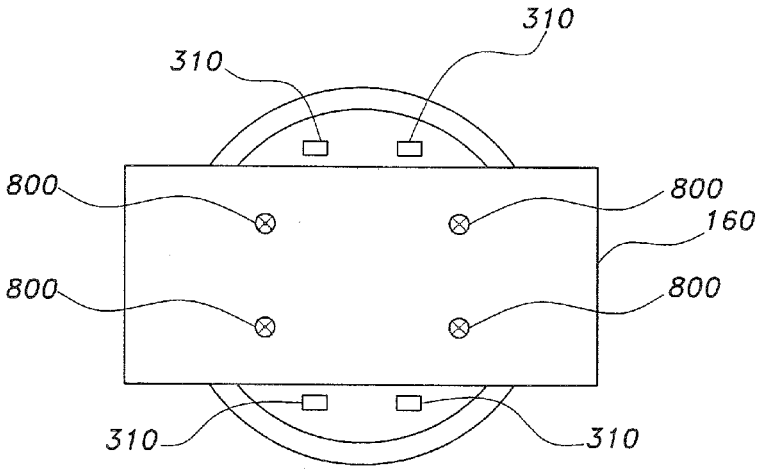
FIG. 8 is a bottom view of a base of the water dispenser for personal hygiene, according to the present invention.

The water dispenser 100*a* also includes an elongated push member 600 (FIG. 6). The elongated push member 600 can be pushed downward, as illustrated by arrow A, to cause the upper cover member 110*a* to compress the compressible member 130 and discharge water. The elongated push member 600 is attachable to the attachment member 119 positioned on the upper cover member 110*a*. The elongated push member 600 includes a plurality of evenly spaced holding spheres 620 positioned along the elongated push member 600. Each of the holding spheres 620 are configured for preventing a user's hand from slipping downward while exerting downward pressure on the elongated push member 600. The elongated push member 600 can have any suitable length depending on a user's height and positioning (i.e. the elongated push member 600 can be manufactured at differing heights).

Figure 9:
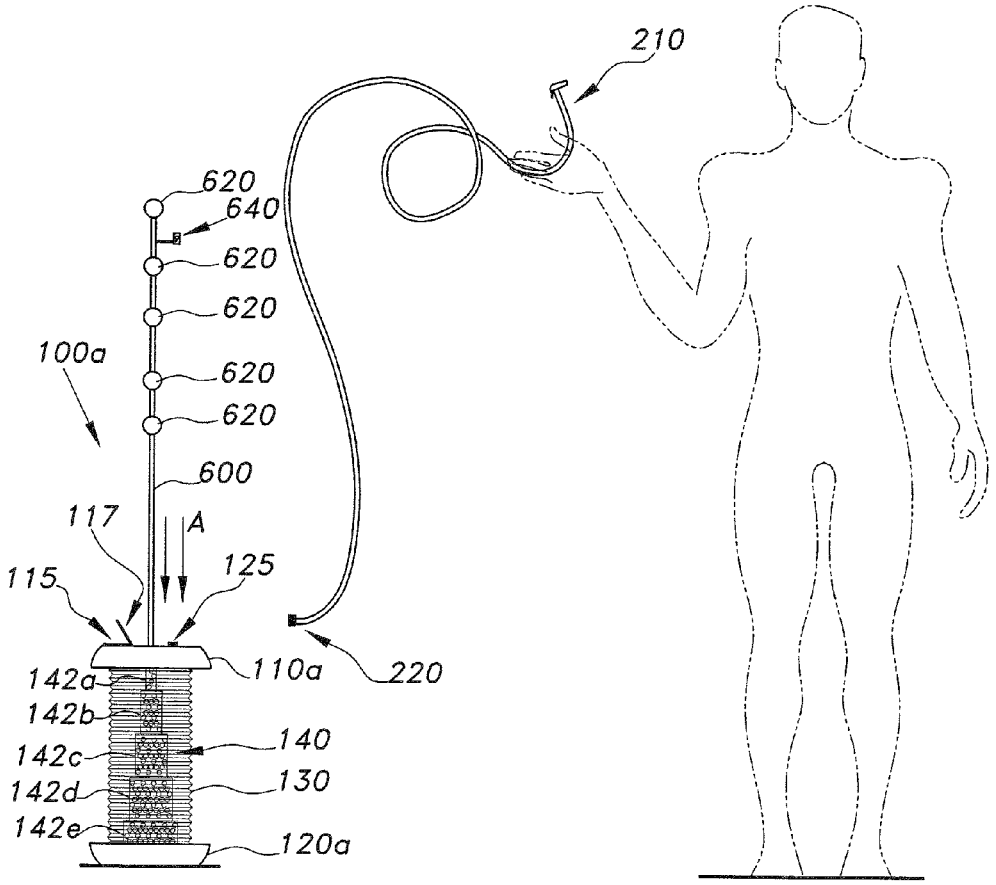
FIG. 9 illustrates one way in which the water dispenser for personal hygiene may be used, according to the present invention.

The elongated push member 600 can also include a plurality of openings 630. Each of the plurality of openings 630 (FIG. 7) can receive a hook 640 (FIGS. 6 and 9). The hook 640 can be removably positioned in a respective one of the plurality of openings 630. The hook 640 is configured for supporting or storing the hose 200 after use. The hook 640 can be removably positioned onto the elongated push member 600 at any suitable height. For example, the hook 640 can be pulled away from one opening 630 and inserted into another opening 630.

Figure 10:
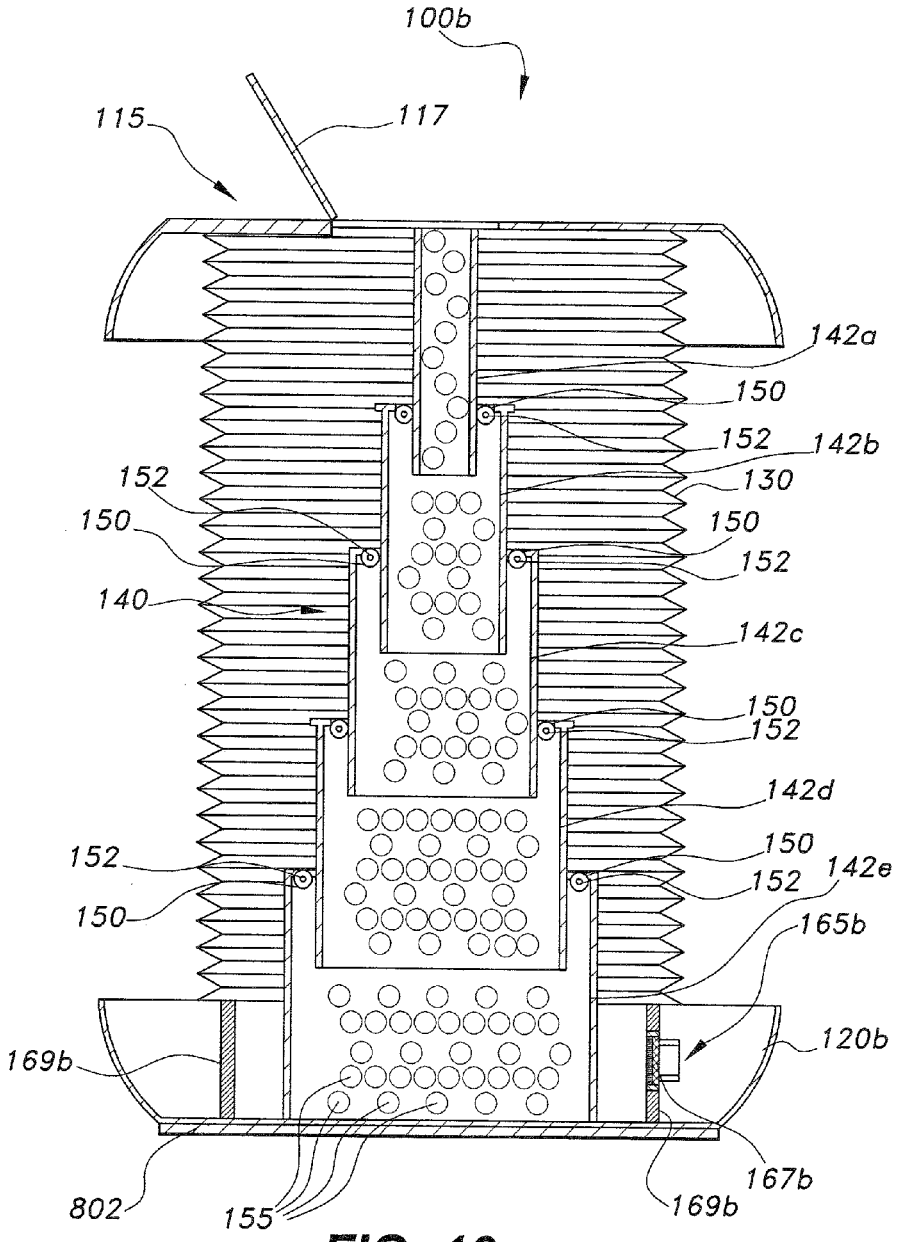
FIG. 10 is a cross sectional view of an alternative embodiment of a water dispenser for personal hygiene, according to the present invention.
Figure 11:
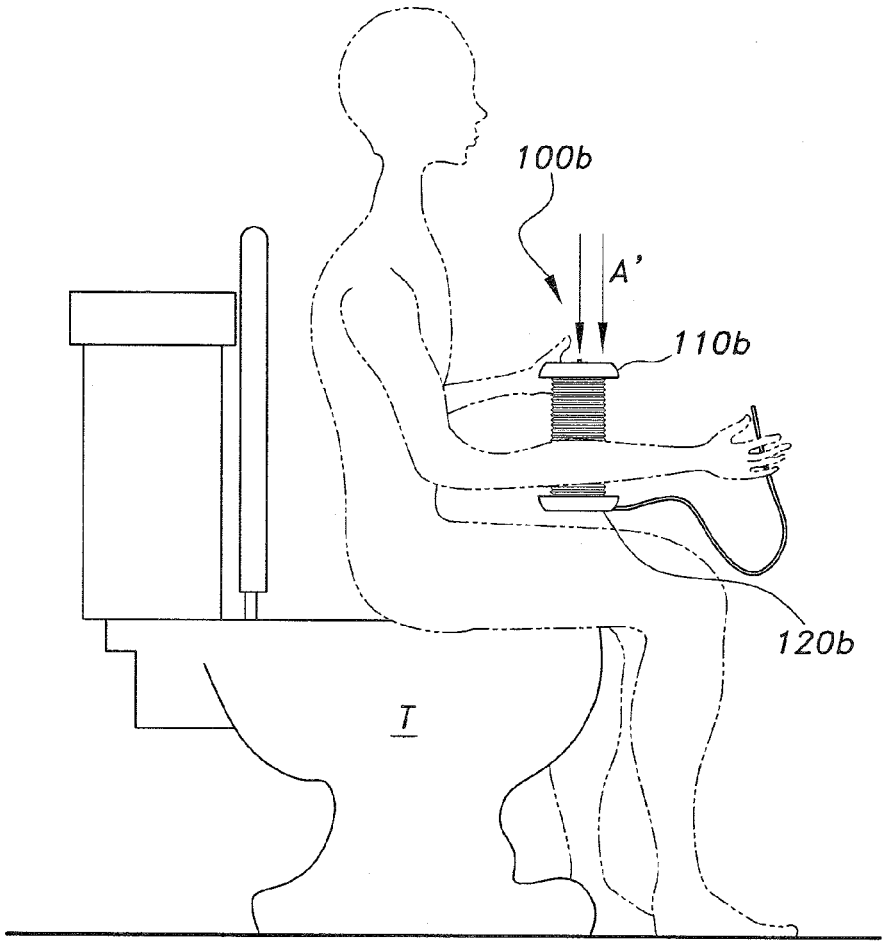
FIG. 11 illustrates one way in which the alternative embodiment of the water dispenser for personal hygiene may be used, according to the present invention.

Referring to FIGS. 10 and 11, a second embodiment of a water dispenser, generally designated as 100*b*, is shown. The water dispenser 100*b* is substantially similar to the water dispenser 100*a*. However, the water dispenser 100*b* can be smaller and lighter than water dispenser 100*a*, and includes an opening 165*b* defined in the lower cover member 120*b*, as illustrated in FIG. 10. The lower cover member 120*b* includes a supporting ring 169*b*. Similar to the second opening 125 of the upper cover member 110*a* and the opening 165*a* of the lower cover member 120*a* of the water dispenser 100*a*, the opening 165*b* of the lower member 120*b* of the water dispenser 100*b* is configured to allow water to be dispensed from the bottom of the water dispenser 120*b*, as illustrated in FIG. 11. Furthermore, similar to the opening 165*a* of the lower cover member 120*a*, a wire mesh 167*b*, as illustrated in FIG. 10, and optionally, a thin fabric (not shown) can extend across the opening 165*b* of the lower cover member 120*b* for filtering and softening the water flow before the water is discharged through the hose 200. The lower cover member 120*b* can include a supporting ring 169*b*. The lower cover member 120*b* can include a rubber portion 802 adapted to prevent, such as substantially prevent, the lower cover member 120*b* from slipping along a surface, such as a user's lap or a floor surface, while the water dispenser 100*b* is being used.

By way of operation, after removing the at least one rubber band 610, the upper cover member 110*a* or 110*b* can be pulled in a direction away from the lower cover member 120*a*, 120*b* so as to expand the cylindrical, accordion-like compressible member 130 and extend the telescoping tower 140. Once the cylindrical, accordion-like compressible member 130 and the telescoping tower 140 have been expanded, the cap 117 configured for covering the first opening 115 of the upper cover member 110*a*, 110*b* can be opened to fill the water dispenser 100*a*, 100*b* with fluid, such as water, such as from a sink faucet (not shown).

It is to be understood that the water dispenser 100*a*, 100*b* can also be filled with water from an alternative water source, such as a lake, sea, water bucket, or tub, by first attaching the proximal end 220 of the hose 200 to either the second opening 125 of the upper cover member 110*a* or the opening 165*a* of the lower cover member 120*a* of the water dispenser 100*a* or to the opening 165*b* of the lower cover member 120*b* of the water dispenser 100*b*. Once the proximal end 220 of the hose 200 is attached to the water dispenser 100*a*, 100*b*, the distal end 210 of the hose 200 can be submerged into the alternative water source, and the upper cover member 110*a*, 110*b* and the lower cover member 120*a*, 120*b* can then be separated from one another, as described above, so as to expand the cylindrical, accordion-like compressible member 130 and to draw water into the cylindrical, accordion-like compressible member 130, as well as into the telescoping member 140, such as through each of the plurality of openings 155 of each tier 142*a*-142*e*.

A user may then insert the end of the elongated push member 600 downward, as illustrated by arrow A, onto the attachment member 119 of the upper cover member 110*a* to press the upper cover member 110*a* downward towards the lower cover member 120*a* to discharge the water through the hose 200. When using the water dispenser 100*b*, one hand can be used to press the upper cover member 110*b* downwards, as illustrated by arrows A', toward the lower cover member 120*b* to discharge the water through the hose 200. It is to be understood that the water dispenser 100*b* can also be positioned on a surface, such as a counter, depending on the body position of the user.

Regardless of which water dispenser 100*a*, 100*b* is being used, a user can press downward on the upper cover member 110*a*, 110*b* to dispense water, such as through openings 125, 165*a* of the water dispenser 100*a* and through the opening 165*b* of the water dispenser 100*b*. The user can stop pressing on the upper cover member 110*a*, 110*b* to stop dispensing water. The upper cover member 110*a*, 110*b* of the water dispenser 100*a*, 100*b*, respectively, will then remain at the level at which the user stopped pressing and will not expand back to the upper cover member's 110*a*, 110*b* original position unless the user pulls the upper cover member 110*a*, 110*b* away from the lower cover member 120*a*, 120*b*. The hose 200 may be disconnected from the second opening 125 of the upper cover member 110*a* or the opening 165*a* of the lower cover member 120*a* of water dispenser 100*a*, or from the opening 165*b* of the lower cover member 120*b* of water dispenser 100*b* and stored in the storage compartment 500 of the lower cover member 120*a*, 120*b*. The at least one rubber band 610 can then be wrapped around the water dispenser 100*a*, 100*b* once the upper cover member 110*a*, 110*b* and the lower cover member 120*a*, 120*b* of the water dispenser 100*a*, 100*b* have been completely compressed, so that all of the components remain together to facilitate storage and/or transport.

It is to be understood that the present invention is not limited to the embodiments described above, but encompasses any and all embodiments within the scope of the following claims.

I claim:

1. A water dispenser for personal hygiene, comprising:

an upper cover member and a lower cover member, the upper cover member having a first opening and a second opening extending therethrough;

a compressible member disposed between the upper cover member and the lower cover member;

a telescoping tower disposed within the compressible member between the upper cover member and the lower cover member, the telescoping tower including a plurality of tiers, each tier of the plurality of tiers having a plurality of openings contained in a plurality of rows about the perimeter thereof; and a hose having a proximal end and a distal end, the proximal end being releasably attached to the second opening of the upper cover member, wherein the compressible member and the plurality of openings in each of the tiers allow pressure control of water through the hose.

2. The water dispenser for personal hygiene according to claim 1, wherein the lower cover member comprises an opening.

3. The water dispenser for personal hygiene according to claim 1, further comprising an elongated push member coupled to the upper cover member.

4. The water dispenser for personal hygiene according to claim 3, wherein the elongated push member further comprises a plurality of evenly spaced holding spheres positioned along a surface of the elongated push member.

5. The water dispenser for personal hygiene according to claim 4, wherein the elongated push member further comprising a plurality of openings and a hook releasably inserted into a respective one of the openings.

6. The water dispenser for personal hygiene according to claim 1, wherein the lower cover member includes a base having step-on member.

7. The water dispenser for personal hygiene according to claim 6, wherein the base includes a plurality of wheels configured for transporting the water dispenser.

8. The water dispenser for personal hygiene according to claim 7, wherein the plurality of wheels are retractable wheels.

9. The water dispenser for personal hygiene according to claim 6, wherein the base includes a rubber material.

10. The water dispenser for personal hygiene according to claim 1, further comprising a water sprayer coupled to the distal end of the hose.

11. The water dispenser for personal hygiene according to claim 1, further comprising a bendable extension member releasably coupled to the distal end of the hose, the bendable extension member configured for discharging water dispensed from the hose.

12. The water dispenser for personal hygiene according to claim 11, wherein the bendable extension member includes a plurality of bendable metal rods positioned within the bendable extension member.

13. A water dispenser for personal hygiene, comprising:

an upper cover member and a lower cover member, the lower cover member including an opening;

a compressible member disposed between the upper cover member and the lower cover member;

a telescoping tower disposed within the compressible member between the upper cover member and the lower cover member, the telescoping tower including a plurality of tiers, each tier of the plurality of tiers having a plurality of openings contained in a plurality of rows about the perimeter thereof;

a hose having a proximal end and a distal end, the proximal end being releasably attached to the opening of the lower cover, wherein the compressible member and the plurality of openings in each of the tiers allow pressure control of water through the hose; and a bendable extension member releasably coupled to the distal end of the hose, the extension member configured for discharging water dispensed from the hose, wherein the extension member includes a plurality of bendable metal rods positioned within the bendable extension member.

14. The water dispenser for personal hygiene according to claim 13, wherein the lower cover member includes a base.

15. The water dispenser for personal hygiene according to claim 14, wherein the base includes a rubber material.

16. The water dispenser for personal hygiene according to claim 13, further comprising a water sprayer coupled to the distal end of the hose.

* * * * *